US006381421B1

(12) United States Patent
Katahira

(10) Patent No.: US 6,381,421 B1
(45) Date of Patent: Apr. 30, 2002

(54) IMAGE FORMING APPARATUS HAVING IMPROVED DEVELOPER FILLING CAPABILITY

(75) Inventor: Shunsuke Katahira, Hachioji (JP)

(73) Assignee: Toshiba TEC Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/665,176

(22) Filed: Sep. 19, 2000

(51) Int. Cl.[7] ..... G03G 15/08

(52) U.S. Cl. ..... 399/27; 399/30; 399/58; 399/62

(58) Field of Search ..... 399/24, 27, 29, 399/30, 58, 61, 62

(56) References Cited

U.S. PATENT DOCUMENTS

| | | | | |
|---|---|---|---|---|
| 4,903,051 A | * | 2/1990 | Egawa et al. | |
| 4,942,431 A | * | 7/1990 | Tada | 399/58 |
| 5,038,175 A | * | 8/1991 | Sohmiya et al. | 399/58 |
| 5,162,848 A | * | 11/1992 | Saitoh et al. | 399/27 |
| 5,826,134 A | * | 10/1998 | Hino et al. | 399/27 |
| 5,862,430 A | | 1/1999 | Mitekura et al. | 399/13 |
| 5,887,217 A | | 3/1999 | Mitekura et al. | 399/112 |
| 5,983,047 A | * | 11/1999 | Lee | 399/58 X |

FOREIGN PATENT DOCUMENTS

| | | | |
|---|---|---|---|
| JP | 3-210586 | * | 9/1991 |
| JP | 7-64386 | | 3/1995 |
| JP | 9-160471 | | 6/1997 |
| JP | 9-179405 | | 7/1997 |

* cited by examiner

*Primary Examiner*—Susan S.Y. Lee
(74) *Attorney, Agent, or Firm*—Foley & Lardner

(57) ABSTRACT

An image forming apparatus is provided with a plurality of developing units containing developer used for supplying the developer to an image bearer. The image forming apparatus also includes a plurality of detectors for detecting densities of the developer in the plurality of developing units, and a replenishing unit for replenishing the plurality of developing units with a developer based on detection results output from the plurality of detectors. The image forming apparatus further includes a plurality of control units for executing a plurality of replenishment operation from the replenishment unit to a developing unit based on the developer density in the plurality of developing units, and a developer-empty state detecting unit for detecting a developer-empty state of the replenishment unit.

18 Claims, 4 Drawing Sheets

IMAGE FORMING APPARATUS HAVING IMPROVED DEVELOPER FILLING CAPABILITY

BACKGROUND OF THE INVENTION

The present invention relates to an image forming apparatus, such as a full-color copying machine or a color printer.

In the conventional art, a so-called 4-unit tandem full-color copying machine is known as an image forming apparatus capable of outputting a color image. In the full-color copying machine, four image forming units, which form toner images of yellow (Y), magenta (M), cyan (C) and black (B) on the basis of image signals obtained by color decomposition, are arranged along a conveyance belt.

The image forming unit for each color includes: a photosensitive drum which is in rolling contact with a conveyance belt; a charging device for charging the surface of the drum to have a predetermined potential level; an exposure device for forming an electrostatic latent image by exposing the surface of the drum to light; a developing device (a developing unit) for developing the electrostatic latent image formed on the surface of the drum by supplying toner thereto; and a transfer device for transferring the developed toner image to a recording sheet, which is carried in the adsorbed state on the conveyance belt. When the recording sheet adsorbed on the conveyance belt is made to pass by the four image forming units, toner images of the four colors are transferred onto the sheet in a superimposed manner. The recording sheet bearing the toner images is then supplied to a fixing unit, and this fixing unit fixes the toner images onto the recording sheet, thereby forming a color toner image.

The developing device of each image forming unit is provided with a toner sensor used for the sensing of density. A disposal toner hopper, which contains toner for toner replenishment, is attached to the developing device. The toner hopper has a toner replenishment roller, which is rotated when the developing device is replenished with toner.

Based on the density sensed by the toner sensor of each developing device, the developing device is replenished with toner supplied from the toner hopper, or a shortage of toner inside the toner hopper is determined.

Let us assume that in the four-unit tandem full-color copying machine described above, the toner density of the developing device of one of the four image forming units becomes low during a copying operation (more than A and less than C, A<C). In this case, the developing device is replenished with toner from the toner hopper during the interval between two successive recording sheets, without the copying operation being brought to a halt. If the toner density becomes further lower, the toner replenishment performed in the interval between the two successive recording sheets may be insufficient. In this case, the developing device is replenished with toner from the toner hopper after the copying operation is brought to a halt. If the toner replenishment without the copying operation does not raise the toner density of the developing device to be more than a predetermined level (less than A), then the toner hopper is determined to contain no toner. In the manner described above, the toner-empty state is sensed without providing a remaining-toner-amount sensor inside the toner hopper.

According to the conventional art, when toner is supplied to a toner hopper of density of less than "A" without performing the copying operation, a developing device of different color is not replenished with toner. This being so, when the copying operation is resumed, it is likely that the toner density of another developing device becomes less than "A." In this case, the copying operation has to be interrupted again, for toner supply. In short, the convention art entails the problem that the copying operation has to be sometimes interrupted so as to replenish a developing device with a toner hopper.

BRIEF SUMMARY OF THE INVENTION

Accordingly, an object of the present invention is to prevent an image forming operation from being often interrupted for toner replenishment, by bringing the image forming operation to a halt and starting toner replenishment from the toner hopper in response to a low-density state of the developing device of one of a plurality of image forming units, and by simultaneously supplying toner to developing devices of other image forming units if those developing devices are in the low-density state as well.

To achieve this object, the present invention provides an image forming apparatus comprising: a plurality of developing means containing a developer inside and used for supplying the developer to an image bearer; a plurality of detectors for detecting densities of the developer in the plurality of developing means; replenishment means for replenishing the plurality of developing means with a developer based on detection results output from the plurality of detectors; first control means for executing a replenishment operation from the replenishment means to a developing means when detection by the plurality of detectors shows that the developer density is not more than a first density value in at least one of the developing means; second control means for executing a replenishment operation from the replenishment means to all the developing means whose developer densities are not more than the first density value until the developer densities exceed a predetermined density value, when detection by the plurality of detectors shows that the developer density is not more than a second density value, which is lower than the first density value in at least one of the developing means; and developer-empty state detecting means for detecting a developer-empty state of the replenishment means if the developer density of the developing means for which the replenishment operation is performed does not exceed the predetermined density value even after the replenishment operation by the second control means is executed for more than a predetermined period of time.

The present invention also provides an image forming apparatus comprising: a plurality of developing means containing a developer inside and used for supplying the developer to an image bearer; a plurality of detectors for detecting densities of the developer in the plurality of developing means; replenishment means for replenishing the plurality of developing means with a developer, based on detection results output from the plurality of detectors; first control means for executing a replenishment operation from the replenishment means to a developing means when detection by the plurality of detectors shows that the developer density is not more than a first density value in at least one of the developing means; second control means for executing a replenishment operation from the replenishment means to a developing means when detection by the plurality of detectors shows that the developer density is not more than a second density value, which is lower than the first density value in at least one of the developing means; third control means for executing a replenishment operation from the replenishment means to all the developing means whose developer densities are not more than the second density value until the developer densities exceed the first density value, when detection by the plurality of detectors shows that the developer density is not more than a third density value, which is lower than the second density value in at least one of the developing means; and developer-empty state detecting means for detecting a developer-empty state of the replenishment means if the developer density of the developing means for which the replenishment operation is performed does not exceed the first density value even after the replenishment operation by the third control means is executed for more than a predetermined period of time.

The present invention further provides an image forming method comprising: a detection step for detecting developing densities of a plurality of developing means each for supplying the developer to an image bearer; a first replenishment step for replenishing developing means from a developer replenishing means if the detection step shows that the developer density of at least one of the developing means is not more than a first density value; second replenishment step for executing a replenishment operation to all developing means whose developer densities are not more than the first density value, until the developer densities exceed a predetermined density value, when the detection step shows that the developer density is not more than a second density value which is lower than the first density value in at least one of the developing means; and a developer-empty state detecting step for detecting a developer-empty state of the replenishment means if the developer density of the developing means for which the replenishment operation is performed does not exceed the predetermined density value even after the replenishment operation is executed for more than a predetermined period of time.

DETAILED DESCRIPTION OF THE INVENTION

An embodiment of the present invention will now be described with reference to the accompanying drawings.

Figure 1:
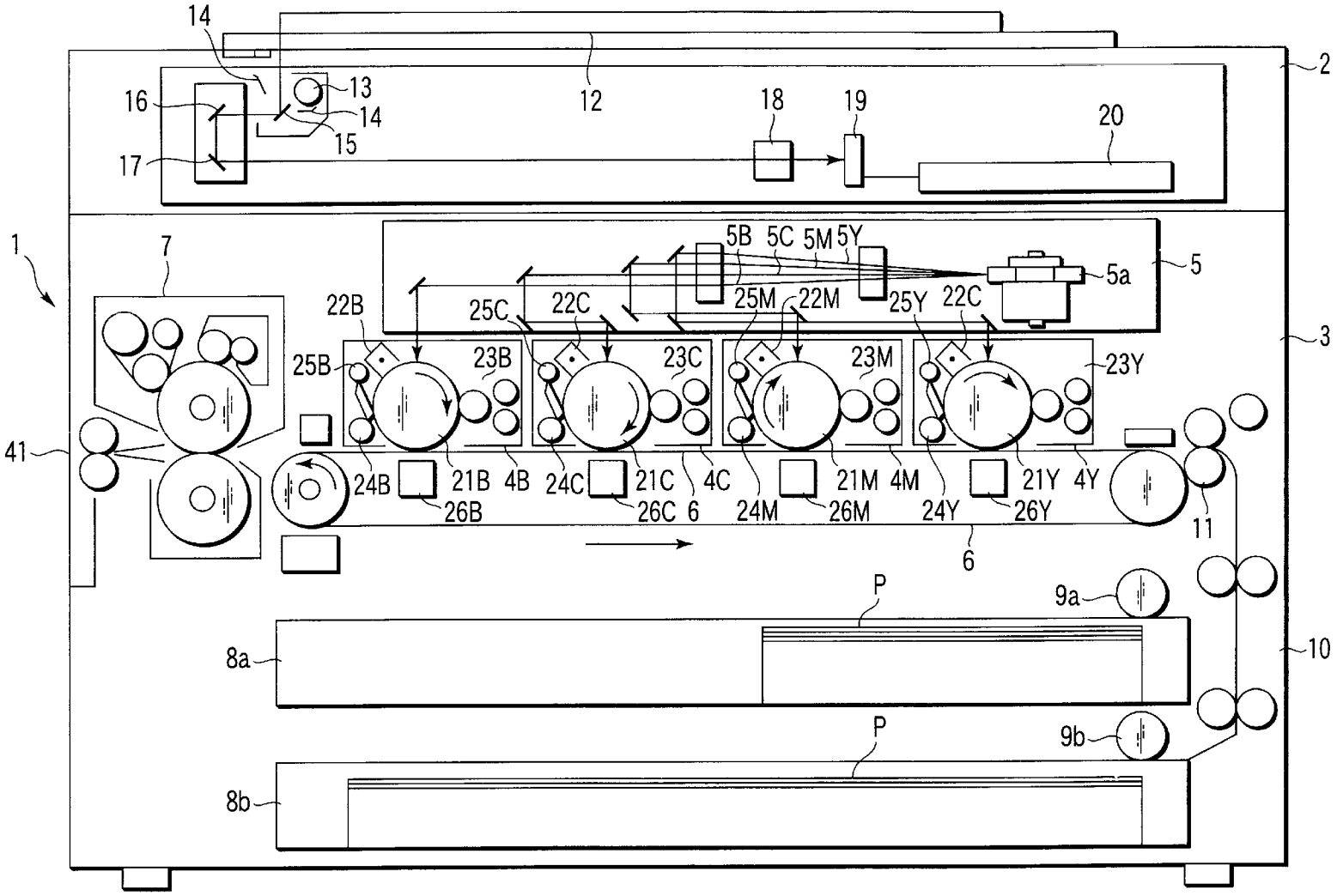
FIG. 1 is a schematic diagram showing a color image forming apparatus.

FIG. 1 is a schematic diagram showing a color digital copying machine, which is an example of a color image forming apparatus according to the present invention.

As shown in FIG. 1, the color digital copying machine 1 comprises: a scanner 2 for reading image information on an object as optical intensities and generates image signals; and an image forming device 3 for forming an image corresponding to the image signals that are supplied from the scanner 2 or an external apparatus.

The scanner 2 is provided with: an illumination lamp 13 for illuminating a document (not shown) placed on a document table 12; a reflector 14 for guiding the light emitted from the illumination lamp 13 toward the document and for converging the light on the document; an optical system 18 including reflecting mirrors 15, 16 and 17 and an image-forming lens and used for guiding the reflected light from the document to a light-receiving element 19; the light-receiving element 19 which is, for example, a CCD and converts the light from the document into electric signals; and an image processing device 20 for performing color decomposition for the electric signals obtained by the photoelectric conversion, thereby obtaining image signals corresponding to yellow (Y), magenta (M), cyan (C) and black (B).

The image forming device 3 is made up of the following: four image forming units (image forming sections) 4Y, 4M, 4C and 4B for forming three colors of subtractive primaries Y (yellow), M (magenta) and C (cyan) and forming the color of B(black) for providing a clear contrast; photosensitive drums 21Y, 21M, 21C and 21B (image bearers) provided for the image forming units 4Y, 4M, 4C and 4B, respectively; an exposure device 5 for emitting an exposure beam, such as a laser beam, which is discretely changed in optical intensity in accordance with an image signal supplied from the scanner 2 or the external apparatus; a transfer belt 6 for conveying a sheet P serving as a transfer member (i.e., a medium on which an image is to be formed) and for permitting images formed by the image forming units 4Y, 4M, 4C and 4B to be transferred on the sheet P in a superimposed manner; and a fixing device 7 for providing pressure to the sheet P conveyed by the transfer belt 6 and the images (developer images) on the sheet P while simultaneously applying heat to them.

Figure 2:
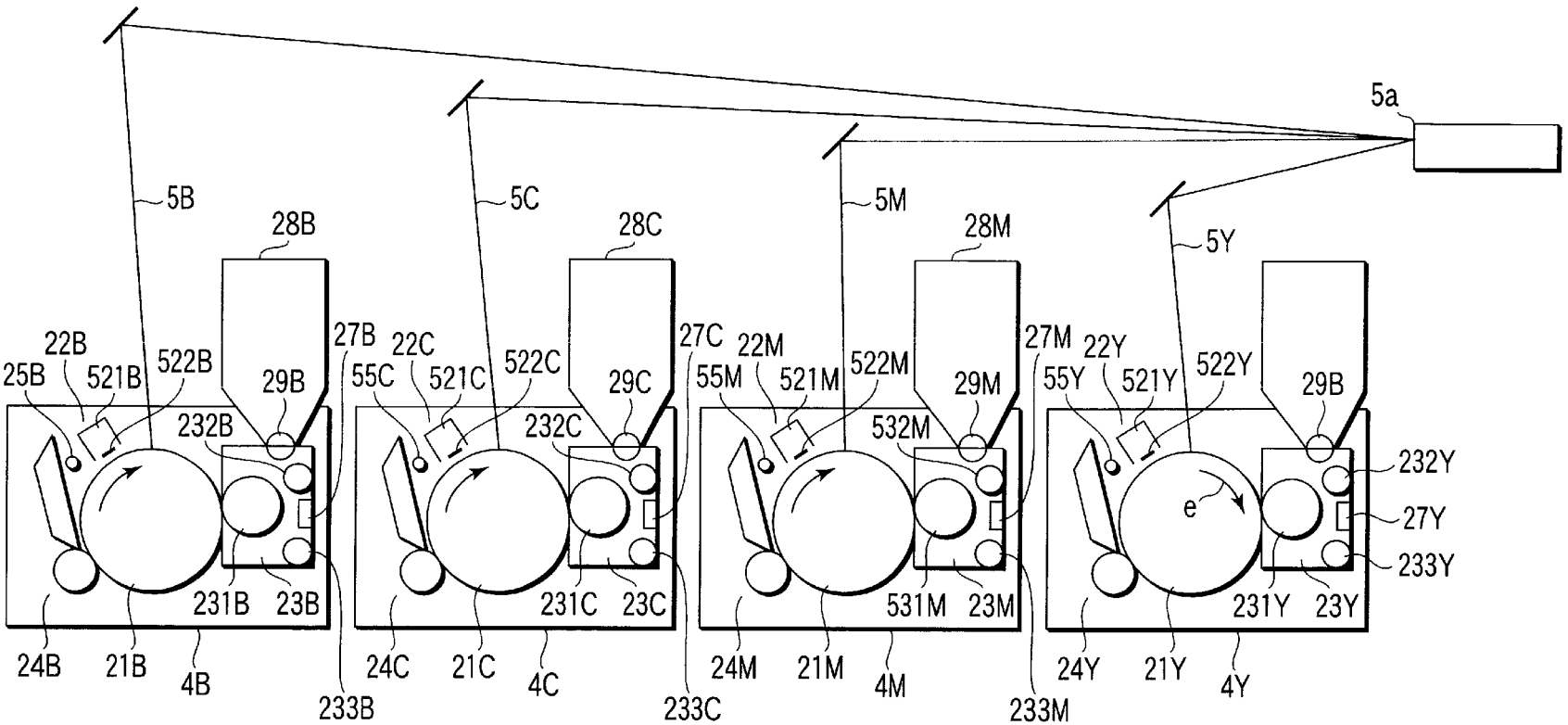
FIG. 2 is a schematic diagram showing the major portion of the color image forming apparatus.

As shown in FIGS. 1 and 2, the image forming units 4Y, 4M, 4C and 4B are substantially similar in structure, and form images of the respective colors by utilization of the known electrophotographic process.

Arranged around the photosensitive drums 21Y, 21M, 21C and 21B are: charging devices 22Y, 22M, 22C and 22B; developing devices (developing means) 23Y, 23M, 23C and 23B containing respective-color developers (each of which is a two-component developer made up of a carrier and toner); transfer devices 26Y, 26M, 26C and 26B; cleaning devices 24Y, 24M; 24C and 24B; and electrically discharging devices 25Y, 25M, 25C and 25B. These structural elements are arranged in the rotating direction of the drums, as shown in FIGS. 1 and 2. With this structure, color images corresponding to laser beams 5Y, 5M, 5C and 5B which are emitted from the exposure device 5 and scanned by a polygon mirrors are formed in accordance with the color-decomposed image signals.

The developing devices (developing units) 23Y, 23M, 23C and 23B are respectively provided with: developing rollers 231Y, 231M, 231C and 231B arranged close to the photosensitive drums 21Y, 21M, 21C and 21B; upper stirring rollers 232Y, 232M, 232C and 232B for stirring the respective color developers; lower stirring rollers 233Y, 233M, 233C and 233B for stirring the respective color developers; and density-sensing toner sensors (detectors) 27Y, 27M, 27C and 27B.

Disposable toner hoppers (replenishing means) 28Y, 28M, 28C and 28B, each containing replenishing toner, are attached to the developing devices 23Y, 23M, 23C and 23B, respectively. The toner hoppers 28Y, 28M, 28C and 28B are respectively provided with toner replenishing rollers 29Y, 29M, 29C and 29B, which are rotated when toner is supplied to the corresponding developing devices 23Y, 23M, 23C and 23B.

Based on the densities sensed by the toner sensors 27Y, 27M, 27C and 27B inside the developing devices 23Y, 23M, 23C and 23B, a copy control circuit (to be described later) executes toner replenishment from the toner hoppers 28Y, 28M, 28C and 28B to the developing devices 23Y, 23M, 23C and 23B. Moreover, the copy control circuit determines whether or not toner hoppers 28Y, 28M, 28C and 28B contain toner therein.

The transfer devices 26Y, 26M, 26C and 26B are arranged in such a manner as to face the respective photosensitive drums 21Y, 21M, 21C and 21B. The transfer belt 6 running along the lower path is located between the transfer devices 26Y, 26M, 26C and 26B and the photosensitive drums 21Y, 21M, 21C and 21B.

Sheet cassettes 8*a* and 8*b* are located under the transfer belt 6 at predetermined positions. The sheet cassettes 8*a* and 8*b* store sheets P on which toner images formed by the image forming units 4Y, 4M, 4C and 4B are to be transferred. The sheet cassettes 8*a* and 8*b* are provided with pickup rollers 9*a* and 9*b*, by means of sheets P are taken out from the cassettes one by one. A sheet conveyance section 10 is defined between the transfer belt 6 and the sheet cassettes 8*a* and 8*b*. The sheet conveyance section 10 includes guides and rollers, by means of which sheets P taken out by the pickup rollers 9*a* and 9*b* are fed toward the transfer belt 6. The sheet conveyance section 10 is provided with aligning rollers 11 at a predetermined position close to the transfer belt 6. The aligning rollers 11 controls the timings when sheets P are fed to the transfer belt 6, whereby a sheet P taken out from one of the cassettes and fed along the sheet conveyance section is adjusted with reference to the images formed by the image forming units 4Y, 4M, 4C and 4B.

In the color image forming apparatus 1 shown in FIG. 1, when image signals are supplied from the scanner 2 or external apparatus, the exposure drums 21Y, 21M, 21C and 21B of the image forming units 4Y, 4M, 4C and 4B are charged to have a predetermined potential by a charging power supply device (not shown). A laser beam, which is discretely varied in optical intensity in accordance with the image signals, is radiated toward the photosensitive drums 21Y, 21M, 21C and 21B.

By the laser beam, an electrostatic latent image corresponding to a color image to be output is formed on the photosensitive drums 21Y, 21M, 21C and 21B of the four image forming units 4Y, 4M, 4C and 4B. The times when images are formed by exposure on the photosensitive drums 21Y, 21M, 21C and 21B of the image forming units 4Y, 4M, 4C and 4B are defined in a predetermined order in accordance with the manner in which a sheet P is carried on the transfer belt 6.

The electrostatic latent images formed on the photosensitive drums 21Y, 21M, 21C and 21B of the image forming units 4Y, 4M, 4C and 4B are developed when they are selectively supplied with toner from the developing devices 23Y, 23M, 23C and 23B, which are arranged in the respective image forming units 4Y, 4M, 4C and 4B and which contain respective-color developers (each of which is a two-component developer made up of a carrier and toner). By the transfer devices 26Y, 26M, 26C and 26B, which face the respective photosensitive drums 21Y, 21M, 21C and 21B, with the transfer belt 6 being located between the transfer devices 26Y, 26M, 26C and 26B and the photosensitive drums 21Y, 21M, 21C and 21B, the developed images are sequentially transferred onto a sheet P on the transfer belt 6. The sheet P is taken out from a cassette, which contains sheets P having size selected beforehand or size corresponding to that of an image formed by exposure performed by the exposure device 5. The taken-out sheet P is conveyed the aligning rollers 11 of the sheet conveyance section 10 and is made to stand by at the aligning rollers 11. In synchronism with the exposure which the exposure device 5 executes for the first-color image or at predetermined timing, the sheet P is conveyed from the aligning rollers 11 toward the transfer belt 6. The sheet P, thus conveyed, is electrically charged by charging devices (directed toward the sheet), which are located in the neighborhood of the rollers of the sheet conveyance section, and are then brought into tight contact with the transfer belt 6.

The sheet P, which bears toner or toner images formed by the image forming units 4Y, 4M, 4C and 4B and transferred to the sheet P, is conveyed to the fixing device 7. By this fixing device 7, the toner is melted and fixed. After passing through the fixing device 7, the sheet P is discharged from a sheet discharge port 41.

The schematic structure of the control circuit of the color image forming apparatus 1 will be described with reference to FIG. 3.

Figure 3:
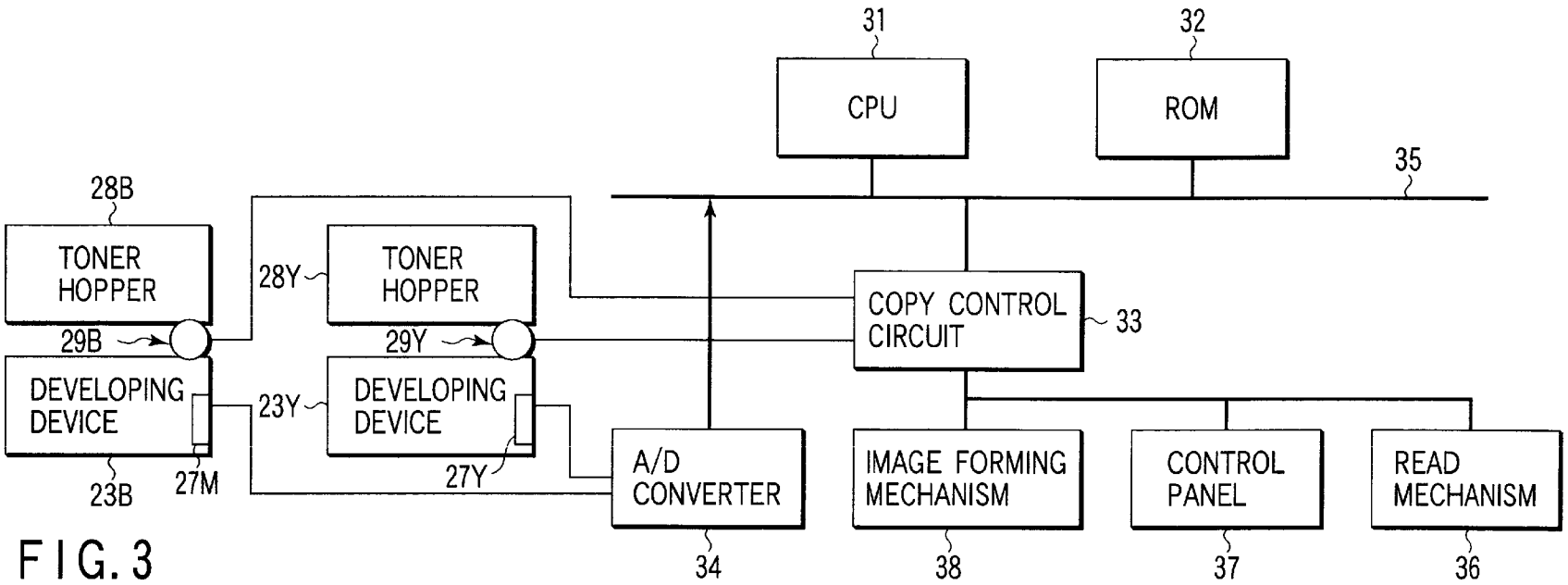
FIG. 3 is a block diagram illustrating a schematic configuration of a control circuit employed in the color image forming apparatus.

As shown in FIG. 3, the color image forming apparatus 1 is provided with a CPU 31, which serves as a control section for controlling the entire apparatus. To the CPU 31, a ROM 32 for storing a control program, a copy control circuit 33 for controlling the copy operation performed by the color image forming apparatus 1, and an A/D converter 34 are connected by way of a bus 34.

The A/D converter 34 receives analog-value sensing signals from the toner sensors 27Y, 27M, 27C and 27B, converts them into digital values, and outputs the digital values to the CPU 31.

To the copy control circuit 33, a read mechanism 36 for driving each portion of the scanner 2, a control panel 37 for entering a variety of settings, and an image forming mechanism 38 for driving each portion of the image forming devices 3, are connected. In addition, the toner replenishing rollers 29Y, 29M, 29C and 29B are connected to the copy control circuit 33 by way of a driver (not shown).

Figure 4:
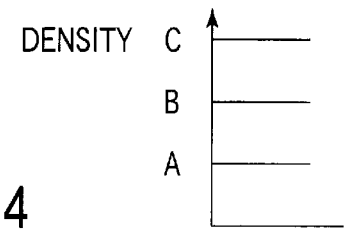
FIG. 4 illustrates the three threshold values of a toner density.

During the copying operation, the CPU 31 compares a toner density, the information on which are supplied from the toner sensors 27Y, 27M, 27C and 27B by way of the A/D converter 34 and the bus 35, with three threshold values shown in FIG. 4, namely, value A (a second density value), value B (a first density value) and value C (a third density value). On the basis of the results of this comparison, the CPU 31 determines whether or not the developing devices 23Y, 23M, 23C and 23B should be replenished with toner. The three threshold values A, B and C are toner densities of 4%, 4.5% and 5%, respectively.

The CPU 31 checks the toner-empty state of the toner hoppers 28Y, 28M, 28C and 28B on the basis of the toner replenishment operations performed for the developing devices 23Y, 23M, 23C and 23B. The toner-empty state is indicated on the control panel 37.

The CPU 31 controls the copy control circuit 33 and actuates a driver (not shown) so as to rotate the toner replenishing rollers 29Y, 29M, 29C and 29B. In accordance with the rotation of the toner replenishing rollers 29Y, 29M, 29C and 29B, the developing devices 23Y, 23M, 23C and 23B are replenished with toner supplied from the corresponding toner hoppers 28Y, 28M, 28C and 28B.

If the toner density of a developing device (23Y, 23M, 23C, 23B) becomes a value that is not less than predetermined value A (e.g., 4%) and not more than predetermined value C (e.g., 5%) during the copying operation, then the CPU 31 controls that developing device to be replenished with toner for a predetermined length of time Tc (e.g., 400 msec). This length of time is defined within the intervals of two successive sheets.

If the toner density of a developing device (23Y, 23M, 23C, 23B) becomes a value that is not less than predetermined value A (e.g., 4%) and not more than predetermined value B (e.g., 4.5%) during the copying operation, then the CPU 31 controls that developing device to be replenished with toner for a predetermined length of time Tb (e.g., 800 msec). This length of time is longer than a given length of time Tc and defined within the intervals of two successive sheets.

If the toner density of a developing device (23Y, 23M, 23C, 23B) becomes a value that is not more than predetermined value A (e.g., 4%) during the copying operation, then the CPU 31 stops the copying operation. Then, the CPU 31 starts toner replenishment for not only the developing device (23Y, 23M, 23C, 23B) whose toner density is not more than predetermined value A (e.g., 4%) but also a developing device or devices (23Y, 23M, 23C, 23B) whose toner densities are not more than predetermined value B. The replenishing toner is supplied to the developing devices (23Y, 23M, 23C, 23B) from the toner hoppers (28Y, 28M, 28C, 28B). When the toner densities have become not less than predetermined value C, the CPU 31 stops the toner replenishment for such developing devices (23Y, 23M, 23C, 23B). When the toner densities of all developing devices 23Y, 23M, 23C, and 23B become not less than predetermined value C, the CPU 31 resumes the copying operation. If a toner density does not reach predetermined value C after the elapse of a predetermined time, then the CPU 31 determines a toner-empty state and displays this state.

On the basis of this display, the user can changes toner hoppers. Since each toner hopper contains a sufficient amount of toner, the toner-empty state does not occur immediately after the copying operation is resumed, and the copying operation can be continued without interruption.

Figure 5:
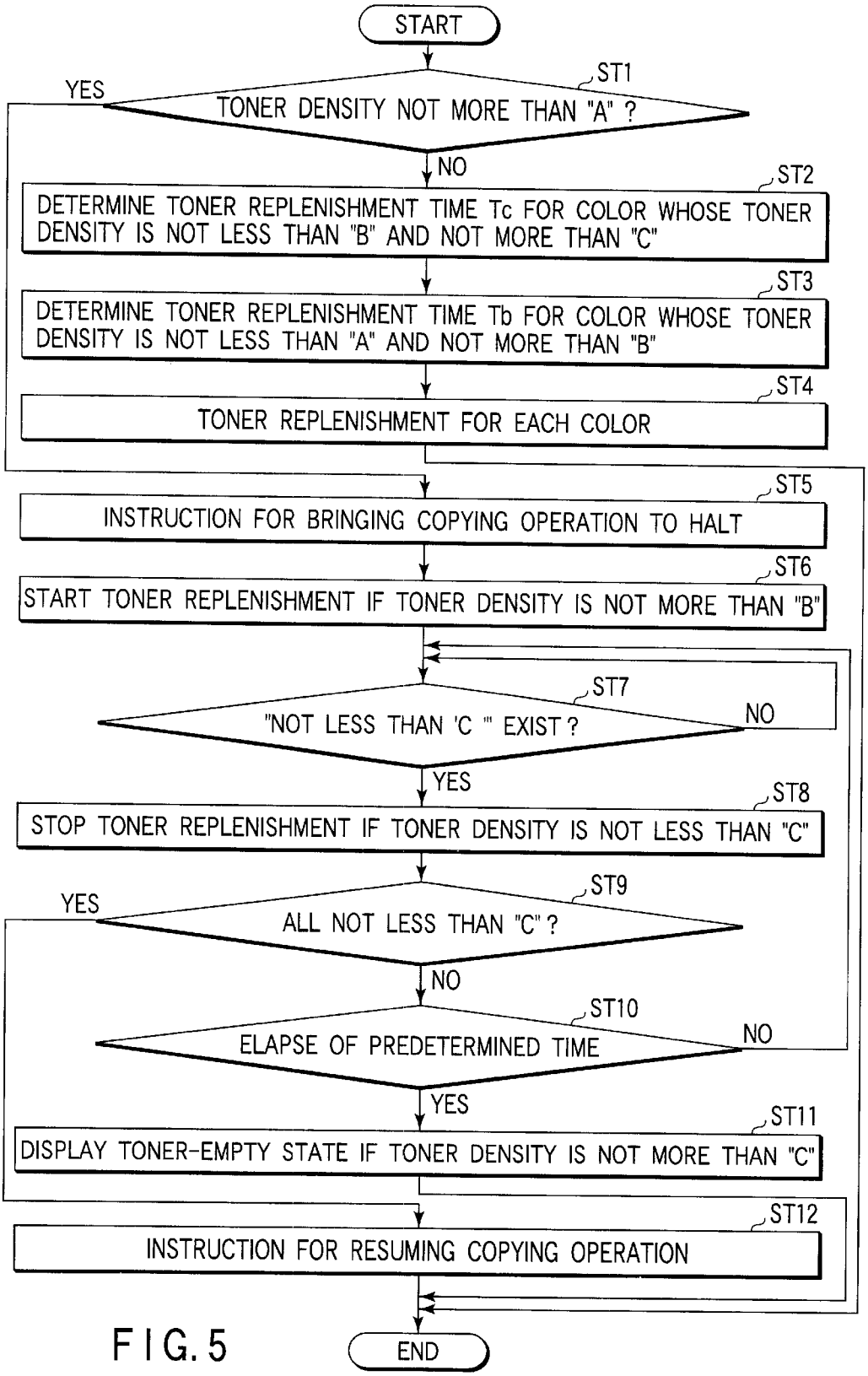
FIG. 5 is a flowchart illustrating the operation for replenishing toner and the operation of determining a toner-empty state of the toner hopper.

A description will now be given with reference to FIG. 5 as to how the toner replenishment operation for the developing devices 23Y, 23M, 23C, and 23B and the toner-empty state determination processing for the 28Y, 28M, 28C and 28B are performed by use of the structure described above.

The CPU 31 checks the four image forming units to detect a developing device 23Y, 23M, 23C or 23B whose toner density becomes a value that is not less than predetermined value A (e.g., 4%) and not more than predetermined value C (e.g., 5%) during the copying operation. Upon detection of such a developing device, the CPU 31 replenishes it with toner for a predetermined length of time Tc (e.g., 400 msec). This length of time is defined within the intervals (e.g., 1 sec) of two successive sheets (ST 1, 2 and 4).

Moreover, the CPU 31 checks the four developing devices 23Y, 23M, 23C and 23B to detect a developing device (23Y, 23M, 23C, 23B) whose toner density becomes a value that is not more than predetermined value A (e.g., 4%). Upon detection of such a developing device, the CPU 31 brings the copying operation to a halt (ST 5). Then, the toner replenishment operation by the CPU 31 is not limited to the developing device (23Y, 23M, 23C, 23B) whose toner density has become a value that is not more than predetermined value A; the replenishment operation is also performed for the developing device or devices (23Y, 23M, 23C, 23B) whose toner densities have become a value that is not more than predetermined value B (ST 6). The toner for replenishment is supplied from the toner hoppers (28Y, 28M, 28C, 28B).

Thereafter, the CPU 31 sequentially stops the toner replenishment operations for the developing devices (23Y, 23M, 23C, 23B) when the toner densities become values that are not less than predetermined value C (ST 7 and ST 8).

When the toner densities of all developing devices 23Y, 23M, 23C, and 23B become not less than predetermined value C, the CPU 31 resumes the copying operation (ST 9 and ST 12).

If a toner density does not reach predetermined value C after the elapse of a predetermined time, then the CPU 31 determines a toner-empty state (ST 10) and displays this state (ST 11).

As described above, the four-unit tandem full-color copying machine operates as follows: During the copying operation, the four image forming units are checked to detect a developing device whose toner density becomes a value that is not less than predetermined value A (e.g., 4%) and not more than predetermined value C (e.g., 5%). If such a developing device is detected, it is replenished with toner for a predetermined length of time Tc (e.g., 400 msec), which is defined within the intervals (e.g., 1 sec) of two successive sheets (ST 1, 2 and 4). Moreover, a check is made to detect a developing device whose toner density becomes a value that is not less than predetermined value A (e.g., 4%) and not more than predetermined value B (e.g., 4.5%). If such a developing device is detected, it is replenished with toner for a predetermined length of time Tb (e.g., 800 msec), which is longer than time Tc and defined between the interval between two successive sheets. If the toner density of one of the four developing devices has become a value that is not more than predetermined value A (e.g., 4%), the copying operation is immediately brought to a halt. In this case, not only the developing device whose toner density has become a value not more than predetermined value B but also the developing device or devices whose toner densities have become a value not more than predetermined value B, are replenished with toner supplied from the toner hoppers. When a toner density becomes a value not less than predetermined value C, the toner replenishment for the corresponding developing device is stopped. When the toner densities of all developing devices have become a value not less than predetermined value C, the copying operation is resumed. If a toner density does not reach predetermined value C after the elapse of a predetermined time, then the occurrence of a toner-empty state is determined and displayed.

When the density of the developing device of one of a plurality of image forming units is sensed as being low (not more than predetermined value A), the copying operation is brought to a halt for the toner replenishment. The toner from the toner hopper is supplied also to the developing devices of the image forming units if the toner densities of those devices are low (not more than predetermined value B). Owing to this feature, the image forming operation is not interrupted for the copying operation.

What is claimed is:

1. An image forming apparatus comprising:

a plurality of developing means containing a developer inside and used for supplying the developer to an image bearer;

a plurality of detectors for detecting developer densities of said plurality of developing means;

replenishment means for replenishing said plurality of developing means with a developer based on detection results output from said plurality of detectors;

first control means for executing a replenishment operation from the replenishment means to a developing means when detection by the plurality of detectors shows that at least one of the developing means has a developer density that is not more than a density value C;

second control means for executing a replenishment operation from the replenishment means to all developing means whose developer densities are not more than a density value B, which is between the density value C and a density value A, until the developer densities exceed the density value C, when detection by the plurality of detectors shows that at least one of the developing means has a developer density that is not more than the density value A, which is lower than the density value C; and developer-empty state detecting means for detecting a developer-empty state of the replenishment means if the developer density of the developing means for which the replenishment operation is performed does not exceed the density value C even after the replenishment operation by the second control means is executed for more than a predetermined period of time.

2. An image forming apparatus according to claim 1, wherein image formation executed by the image forming apparatus is interrupted when the replenishment operation by the second control means is executed.

3. An image forming apparatus according to claim 1, further comprising transfer means for transferring developer images, which are formed by said plurality of developing means, to a plurality of transfer mediums, said first control means executing the replenishment operation of the developer during an interval between image formation corresponding to a predetermined transfer medium and image formation corresponding to a transfer medium that is fed in succession to said predetermined transfer medium.

4. (Amended) An image forming apparatus comprising:

a plurality of developing means containing a developer inside and used for supplying the developer to an image bearer;

a plurality of detectors for detecting developer densities of said plurality of developing means;

replenishment means for replenishing the plurality of developing means with a developer, based on detection results output from said plurality of detectors;

first control means for executing a replenishment operation from the replenishment means to a developing means when detection by said plurality of detectors shows that at least one of the developing means has a developer density that is not more than a density value C;

second control means for executing a replenishment operation from the replenishment means to a developing means when detection by said plurality of detectors shows that at least one of the developing means has a developer density that is not more than a density value B, which is lower than the density value C;

third control means for executing a replenishment operation from the replenishment means to all developing means whose developer densities are not more than the density value B until the developer densities exceed the density value C, when detection by said plurality of detectors shows that at least one of the developing means has a developer density that is not more than a density value A, which is lower than the density value B; and developer-empty state detecting means for detecting a developer-empty state of the replenishment means if the developer density of the developing means for which the replenishment operation is performed does not exceed the density value C even after the replenishment operation by the third control means is executed for more than a predetermined period of time.

5. An image forming apparatus according to claim 4, wherein image formation executed by the image forming apparatus is interrupted when the replenishment operation by the second control means is executed.

6. An image forming apparatus according to claim 4, further comprising transfer means for transferring developer images, which are formed by said plurality of developing means, to a plurality of transfer mediums, said first control means and said second control means executing the replenishment operation of the developer during an interval between image formation corresponding to a predetermined transfer medium and image formation corresponding to a transfer medium that is fed in succession to said predetermined transfer medium.

7. An image forming apparatus according to claim 4, wherein a replenishment time corresponding to the second control means is longer than a developer replenishment time corresponding to the first control means.

8. An image forming method comprising:

a detection step for detecting developing densities of a plurality of developing means each for supplying a developer to an image bearer;

a first replenishment step for replenishing developing means from a developer replenishment means if the detection step shows that the developer density of at least one of the developing means is not more than a density value C;

a second replenishment step for executing a replenishment operation to all developing means whose developer densities are not more than a density value B, which is between a density value A and the density value C, until the developer densities exceed the density value C, when the detection step shows that at least one of the developing means has a developer density that is not more than the density value A which is lower than the density value C; and a developer-empty state detecting step for detecting a developer-empty state of the replenishment means if the developer density of the developing means for which the replenishment operation is performed does not exceed the density value C even after the replenishment operation is executed for more than a predetermined period of time.

9. An image forming method according to claim 8, further comprising a third replenishment step for executing a replenishment operation from the replenishment means when said detection step shows that developing means has a developer density that is not more than the density value B which is lower than the density value C.

10. An image forming method according to claim 9, wherein a replenishment time corresponding to the third replenishment step is longer than a developer replenishment time corresponding to the first replenishment step.

11. An image forming method according to claim 9, further comprising a transfer step for transferring developer images to transfer mediums, said third replenishment step being executed during an interval between a transfer operation to a predetermined transfer medium and a transfer operation to a transfer medium that is fed in succession to said predetermined transfer medium.

12. An image forming method according to claim 8, wherein said developer is a two-component developer made up of a carrier and toner.

13. An image forming method according to claim 8, further comprising a transfer step for transferring developer images to transfer mediums and drying the developer images, said first replenishment step being executed during an interval between a transfer operation to a predetermined transfer medium and a transfer operation to a transfer medium that is fed in succession to said predetermined transfer medium.

14. An image forming method according to claim 8, wherein said second replenishment step is executed, with an image forming operation being interrupted.

15. An image forming method according to claim 14, wherein the image forming operation is resumed when the developer densities of all of said plurality of developer means exceed the density value C during the replenishment operation of the second replenishment step.

16. An image forming method according to claim 8, wherein the replenishment operation of the second replenishment step is brought to a halt when a predetermined density is attained.

17. An image forming method according to claim 8, wherein the developer-empty state detected during the second replenishment step is displayed.

18. An image forming apparatus comprising:

a plurality of developing sections each containing a developer inside and configured to supply the developer to an image bearer;

a plurality of detectors configured to detect developer densities of said plurality of developing sections;

a replenishment section configured to replenish said plurality of developing sections with a developer based on detection results output from said plurality of detectors;

a first control section configured to execute a replenishment operation from the replenishment section to a developing unit when detection by the plurality of detectors shows that at least one of the developing sections has a developer density that is not more than a density value C;

a second control section configured to execute a replenishment operation from the replenishment section to all developing sections whose developer densities are not more than a density value B, which is between the density value C and a density value A, until the developer densities exceed the density value C, when detection by the plurality of detectors shows that at least one of the developing sections has a developer density that is not more than the density value A, which is lower than the density value C; and a developer-empty state detecting section configured to detect a developer-empty state of the replenishment section if the developer density of the developing section for which the replenishment operation is performed does not exceed the density value C even after the replenishment operation by the second control section is executed for more than a predetermined period of time.

* * * * *